US011333391B2

(12) United States Patent
Chi et al.

(10) Patent No.: US 11,333,391 B2
(45) Date of Patent: May 17, 2022

(54) AIR PORT COMPONENT AND AIR CONDITIONER

(71) Applicants: Gree Electric Appliances (Wuhan) Co., Ltd, Wuhan (CN); Gree Electric Appliances, Inc. of Zhuhai, Zhuhai (CN)

(72) Inventors: Xiaolong Chi, Zhuhai (CN); Jingzhong Zhuang, Zhuhai (CN)

(73) Assignees: Gree Electric Appliances (Wuhan) Co., Ltd., Hubei (CN); Gree Electric Appliances, Inc. of Zhuhai, Guangdong (CN)

( * ) Notice: Subject to any disclaimer, the term of this patent is extended or adjusted under 35 U.S.C. 154(b) by 128 days.

(21) Appl. No.: 16/649,786

(22) PCT Filed: Aug. 24, 2018

(86) PCT No.: PCT/CN2018/102281
§ 371 (c)(1),
(2) Date: Mar. 23, 2020

(87) PCT Pub. No.: WO2019/119849
PCT Pub. Date: Jun. 27, 2019

(65) Prior Publication Data

US 2020/0278131 A1 Sep. 3, 2020

(30) Foreign Application Priority Data

Dec. 22, 2017 (CN) ..... 201711401630.X

(51) Int. Cl.
*F24F 13/14* (2006.01)

(52) U.S. Cl.
CPC ..... *F24F 13/1486* (2013.01)

(58) Field of Classification Search
CPC . F24F 13/1486; F24F 13/14; F24F 2013/1493
(Continued)

(56) References Cited

U.S. PATENT DOCUMENTS 6,196,018 B1 * 3/2001 Mori ..... F24F 1/0073 62/404

FOREIGN PATENT DOCUMENTS

CN 2663863 Y 12/2004
CN 201059719 Y 5/2008
(Continued)

OTHER PUBLICATIONS

Chen, CN 203215932 U English machine translation, Sep. 25, 2013 (Year: 2013).*

(Continued)

*Primary Examiner* — Steven S Anderson, II
*Assistant Examiner* — Phillip Decker
(74) *Attorney, Agent, or Firm* — The Webb Law Firm

(57) ABSTRACT

The present disclosure relates to an air port component and an air conditioner, wherein the air port component includes a first plate body and a second plate body, wherein two longitudinal ends of the first plate body and the second plate body are elastically connected respectively. When the working environment temperature difference is relatively large, even if the difference between the linear expansion coefficients of materials used by the two plate bodies is relatively large, extension or shrinkage generated between the plate bodies due to temperature changes is be compensated by the elastic connection so as to reduce the degree of plastic deformation of the plate bodies due to temperature changes after being used for a period of time, thereby improving the reliability of the operation of the air port component, preventing blockage during the operation, as well as ensuring that the airflow of the air outlet meets the design requirements to prevent condensation due to local overcooling.

15 Claims, 4 Drawing Sheets

(58) Field of Classification Search
USPC ..... 454/333
See application file for complete search history.

(56) References Cited

FOREIGN PATENT DOCUMENTS

| | | | | |
|---|---|---|---|---|
| CN | 101666525 | A | 3/2010 | |
| CN | 202547036 | U | 11/2012 | |
| CN | 203215932 | U | 9/2013 | |
| CN | 103363640 | A | 10/2013 | |
| CN | 104121675 | A | 10/2014 | |
| CN | 104848511 | A | 8/2015 | |
| CN | 106123267 | A | 11/2016 | |
| CN | 107421090 | A | 12/2017 | |
| CN | 108006930 | A | 5/2018 | |
| DE | 102005037156 | A1 * | 2/2007 | ..... F28F 9/0241 |
| EP | 0943875 | A2 | 9/1999 | |
| JP | 2005-121306 | A | 5/2005 | |
| JP | 2007187405 | A | 7/2007 | |
| JP | 2008281303 | A | 11/2008 | |
| JP | 2016-3807 | A | 1/2016 | |

OTHER PUBLICATIONS

Nishimoto, JP 2005-121306 A English machine translation, May 12, 2005 (Year: 2005).*
Feng, CN 104848511 A English machine translation, Aug. 19, 2015 (Year: 2015).*

* cited by examiner

AIR PORT COMPONENT AND AIR CONDITIONER

CROSS-REFERENCE TO RELATED APPLICATIONS

This application is the U.S. national phase of International Application No. PCT/CN2018/102281 filed Aug. 24, 2018, and claims priority to Chinese Patent Application No. 201711401630.X filed on Dec. 22, 2017, the disclosures of which are hereby incorporated by reference in their entirety.

FIELD OF THE INVENTION

The present disclosure relates to the technical field of air conditioners, and in particular, to an air port component and an air conditioner.

BACKGROUND OF THE INVENTION

In various household appliance products, an air deflector is a common part used for realizing air supply or opening and closing an air door, and the main role of the air deflector in the overall structure is to guide air or open and close the air door or to achieve both functions. During the actual use of this type of household appliance products, due to the influence of the global environmental use temperature, the temperature difference is large, resulting in a large deformation of the wind deflector after a period of time.

For example, after the deformation of the air deflector of the air conditioner, at least one of the following adverse effects are brought:

(1) the airflow at an air outlet of the air deflector cannot meet the requirements of the analog theory design due to the deformation of the air deflector, and a change in an air field causes partial overcooling of the air conditioner to generate a condensation problem;

(2) excessive deformation of the air deflector will greatly reduce the aesthetic feeling of the appearance of the product; and (3) after the deformation of the air deflector, it is extremely easy to cause seizure or abnormal noise caused by friction with the air conditioner main body during the operation.

The adverse effects caused by the deformation of the air deflector will affect the performance of the product, therefore how to reduce the deformation of the air deflector is a problem needing to be solved for household appliances such as air conditioners.

SUMMARY OF THE INVENTION

The present disclosure provides an air port component and an air conditioner, which is capable of reducing the deformation degree of a plate body in the air port component.

The present disclosure provides an air port component, comprising a first plate body and a second plate body, wherein two longitudinal ends of the first plate body are elastically connected with two longitudinal ends of the second plate body respectively.

In some embodiments, the air port component comprises an elastic component, wherein the two longitudinal ends of the first plate body are elastically connected with the two longitudinal ends of the second plate body (2) respectively through the elastic components.

In some embodiments, the elastic component comprises an elastic plate, and the elastic plate is connected to the longitudinal ends of the first plate body and the second plate body.

In some embodiments, a first preset gap exists at the connection of the elastic plate and at least one of the first plate body and the second plate body along the longitudinal direction.

In some embodiments, the elastic component further comprises an elastic spacer, and the elastic spacer is disposed in the first preset gap.

In some embodiments, the elastic spacer comprises a rubber pad, and the thickness of the rubber pad in a free state is consistent with the first preset gap; or the elastic spacer comprises a spring, and the height of the spring in the free state is consistent with the first preset gap.

In some embodiments, the elastic plate is disposed on the first plate body, and the elastic plate and the second plate body are detachably connected.

In some embodiments, a first buckle group is disposed on one side of the first plate body facing to the second plate body, a second buckle group is disposed on one side of the second plate body facing to the first plate body, the first buckle group is snapped with the second buckle group, and the elastic plate is located at an outer side of the longitudinal end of the second buckle group and is connected with an end of the second buckle group.

In some embodiments, the air port component comprises a fastener, wherein the elastic plate is connected to a longitudinal end of the second buckle group through the fastener.

In some embodiments, a first preset gap exists between the elastic plate and an outer end of the second buckle group along the longitudinal direction.

In some embodiments, the air port component comprises a flexible pad, wherein a second preset gap exists at a site on which the first buckle group matches the second buckle group, and the flexible pad is disposed between the first plate body and the second plate body and is filled in the second preset gap.

In some embodiments, the first buckle group comprises two groups of first buckle structures disposed at two lateral ends of the first plate body respectively, and each group of first buckle structures comprises a plurality of first buckle structures disposed at intervals along the longitudinal direction of the first plate body; and the second buckle group comprises two groups of second buckle structures disposed at two lateral ends of the second plate body respectively, and each group of second buckle structures comprises strip-shaped buckles extending along the longitudinal direction of the second plate body, and the first buckle structures match with the strip-shaped buckles correspondingly.

In some embodiments, a driving member mounting interface is disposed on the first plate body, so as to mount a driving member capable of driving the first plate body and the second plate body.

In some embodiments, the air port component comprises a cover plate, wherein the cove plate is arranged on the outer side of the elastic component, so as to seal a gap on the longitudinal ends of the first plate body and the second plate body.

In some embodiments, a first guide structure is disposed on one side of the first plate body facing to the second plate body, a second guide structure is disposed on one side of the second plate body facing to the first plate body, the first guide structure and the second guide structure are spaced differently relative to a lateral centerline of the air port component, and are installed in place when the first plate body and the second plate body are correctly mounted.

In some embodiments, the first guide structure and the second guide structure have different heights to form a complementary structure, preventing the first guide structure and the second guide structure from installing in place when the first plate body and the second plate body are incorrectly mounted.

In some embodiments, a first buckle group is disposed on one side of the first plate body facing to the second plate body, and the first guide structure is higher than the first buckle group.

In some embodiments, the elastic plate is disposed on the first plate body, and the first preset gap $a=(L2*A*\Delta T-L1*B*\Delta T)+(E1+E2)$, wherein, L1 represents a distance between two sides of the two longitudinal ends of the second plate body connected by the elastic component;

L2 represents a distance between two inner sides of the elastic plates at both ends of the first plate body;

E1 represents an upper tolerance value of L1, and E2 represents a lower tolerance value of L2;

A represents the coefficient of thermal expansion of the first plate body, B represents the coefficient of thermal expansion of the second plate body, and A>B; and $\Delta T$ represents an environment temperature difference in which the air conditioner is located.

The present disclosure further provides an air conditioner, comprising the air port component.

Based on the above technical solutions, in the air port component of the embodiment of the present disclosure, the corresponding longitudinal ends of the first plate body and the second plate body are elastically connected, in the case of a relatively large working environment temperature difference, even if the difference between the linear expansion coefficients of materials used by the two plate bodies is relatively large, the elastic deformation of the plate bodies due to temperature changes is also be compensated by the elastic connection mode to reduce the degree of plastic deformation of the plate bodies after being used for a period of time, thereby improving the reliability of the operation of the air port component, preventing blockage during the operation, as well as ensuring that the airflow of the air outlet meets the design requirements to prevent condensation due to local overcooling, and also ensuring the aesthetic feeling of the appearance.

BRIEF DESCRIPTION OF THE DRAWINGS

The drawings described herein are used for providing a further understanding of the present disclosure and constitute a part of the present application. Exemplary embodiments of the present disclosure and illustrations thereof are used for explaining the present disclosure, but do not constitute undue limitations to the present disclosure. In the drawings.

DETAILED DESCRIPTION OF THE EMBODIMENTS

Figure 1:
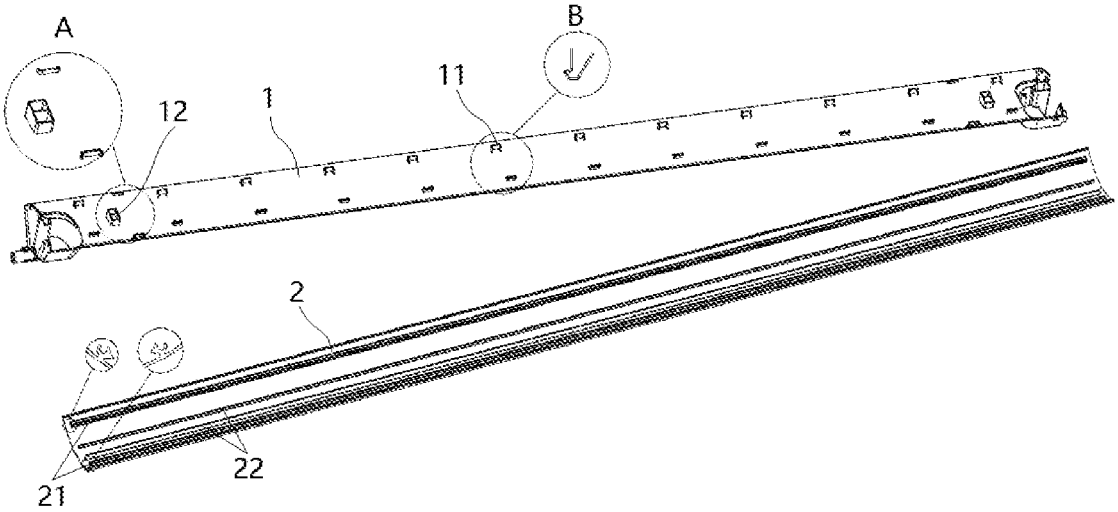
FIG. 1 is a structures schematic diagram of first and second plate bodies in an air port component of the present disclosure.

The present disclosure is explained in detail below. In the following paragraphs, different aspects of the embodiments are defined in more detail. Various aspects so defined may be combined with any other one or more aspects, unless clearly indicated as not being combinable. In particular, any feature that is considered to be preferred or advantageous may be combined with one or more other features that are considered to be preferred or advantageous.

The terms "first" and "second" appearing in the present disclosure are merely for the convenience of description, so as to distinguish different components having the same name, and do not indicate a sequential or primary-secondary relationship.

In the description of the present disclosure, it should be understood that orientation or position relationships indicated by terms such as "upper", "lower", "left", "right", "front", "back", lateral" and "longitudinal" and the like are orientation or position relationships shown on the basis of the drawings, and are merely for the convenience of describing the present disclosure, rather than indicating or implying that the referred devices must have specific orientations or must be constructed and operated in specific orientations, and thus cannot be construed as limiting the protection scope of the present disclosure.

The present disclosure relates to an air port component. Referring to FIG. 1 to FIG. 8, in a schematic embodiment, the air port component includes a first plate body 1 and a second plate body 2, and the first plate body 1 and the second plate body 2 are capable of being connected along the thickness direction through a snap-fit structure. Moreover, two longitudinal ends of the first plate body 1 are elastically connected with two longitudinal ends of the second plate body 2 respectively. Herein, the "longitudinal" is defined as the length direction of the plate body in the air port component, and "lateral" is defined as the width direction of the plate body in the air port component.

For example, in the condition that the air port component is in an air conditioner, the air port component includes an air conditioner air deflector, the first plate body 1 and the second plate body 2 jointly form an air deflector of the air conditioner, the first plate body 1 is an upper air deflector and faces to the interior of the air conditioner, and the second plate body 2 is a lower air deflector and faces to the exterior of the air conditioner. The following embodiments are described by taking it as an example that the air port component is applied to the air conditioner. Alternatively, the first plate body 1 and the second plate body 2 are blades of a louver structure.

In an embodiment of the air port component of the embodiment, in the case of a relatively large working environment temperature difference of the air conditioner, even if the difference between the linear expansion coefficients of materials of the two air deflectors is relatively large, the elastic deformation of the air deflectors due to temperature changes are compensated by the elastic deformation of an elastic component, so as to reduce the degree of plastic deformation of the air deflectors after a period of time, thereby improving the operation reliability of the air port component, preventing blockage during the operation, as well as ensuring that the airflow of the air outlet meets the design requirements to prevent condensation due to local overcooling, and also ensuring the aesthetic feeling of the appearance.

In some embodiments, the air port component of the present disclosure further include an elastic component, and two longitudinal ends of the first plate body 1 are elastically connected with two longitudinal ends of and the second plate body 2 through the elastic component. In the embodiments, there is no need to change the own structure of the upper second plate greatly, and it is easy to realize elastic connection. In the case of the air port component in the condition with a relatively large working environment temperature difference, even if the difference between the linear expansion coefficients of the materials used by the two plate bodies is relatively large, the elastic deformation of the plate bodies due to temperature changes would also be compensated by the elastic deformation of the elastic component. Alternatively, those skilled in the art would also manufacture the longitudinal ends of the plate bodies by using elastic materials, and thus the elastic component is omitted.

Figure 2:
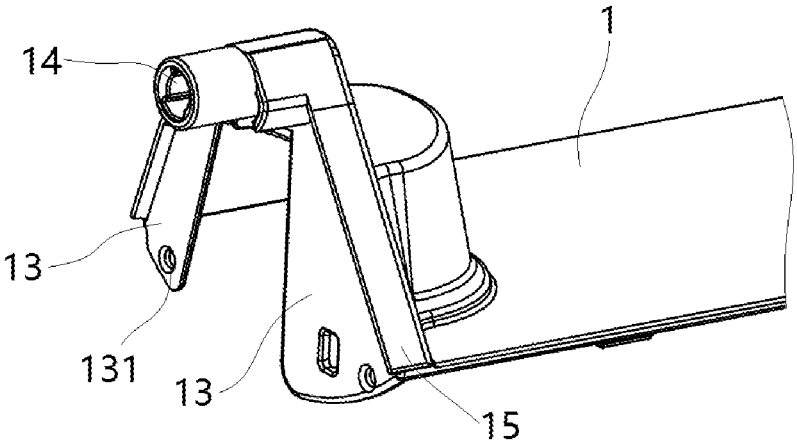
FIG. 2 is a structural schematic diagram of a longitudinal end of a first plate body in the air port component of the present disclosure.

In the embodiment as shown in FIG. 2, the elastic component includes an elastic plate 13, and the elastic plate 13 is connected with the corresponding longitudinal ends of the first plate body 1 and the second plate body 2.

The elastic plate 13 could be formed as following, the elastic plate 13 is disposed at a longitudinal end of one of the first plate body 1 and the second plate body 2 and is connected with a longitudinal end of the other of the first plate body 1 and the second plate body 2 in a state in which the first plate body 1 and the second plate body 2 are snapped. Alternatively, the elastic plate 13 is a separate structural member that is detachably connected with the corresponding longitudinal ends of the first plate body 1 and the second plate body 2 respectively.

The elasticity of the elastic plate 13 are achieved by selecting an elastic material, and the elastic plate 13 are formed as an elastic structure. For example, elastic plates 13 would be disposed at the two longitudinal ends of the plate body, so as to compensate the deformation of the two longitudinal ends of the plate body due to temperature changes through the elastic deformation of the elastic plate 13.

The edges of the first plate body 1 and the second plate body 2 are snapped along the longitudinal direction by a snap-fit structure, and the ends thereof are connected by the elastic plate 13. In the case of the air port component in a relatively large working environment temperature difference, even if the difference between the linear expansion coefficients of the materials used by the two plate bodies is relatively large, the deformation, particularly, extension or retraction of the plate bodies along the longitudinal direction, of the plate bodies due to temperature changes would also be compensated by the elastic deformation of the elastic component, so as to reduce the interaction force of the first and second plate bodies along the longitudinal direction. In this way, the degree of plastic deformation of the first and second plate bodies after a period of time is reduced, for example, the original radian of the entire plate body is ensured or the straightness of the plate body is maintained. Accordingly, the material selection of the first and second plate bodies is relatively wide, such as plastic, aluminum, titanium, or aluminum-magnesium alloy and the like.

The present disclosure reduces the degree of plastic deformation of the plate body, further, when applied to an air conditioner. This advantage would not only prevent blockage of the plate body during operation due to deformation, but also reduces abnormal noise generated by friction between the air deflector and the air conditioner main body, thereby improving the operation reliability of the air port component. In addition, it would also be ensured that the airflow at the air outlet of the air conditioner meets the design requirements to prevent condensation due to local overcooling, furthermore, the elastic plate disposed at the end of the air deflector also blocks cold air from entering between the first and second plate bodies, thus further improving the anti-condensation effect and preventing the occurrence of environmental health and safety issues. In addition, the aesthetic feeling of the appearance of the air conditioner would also be guaranteed, and the cost is reduced.

Figure 7:
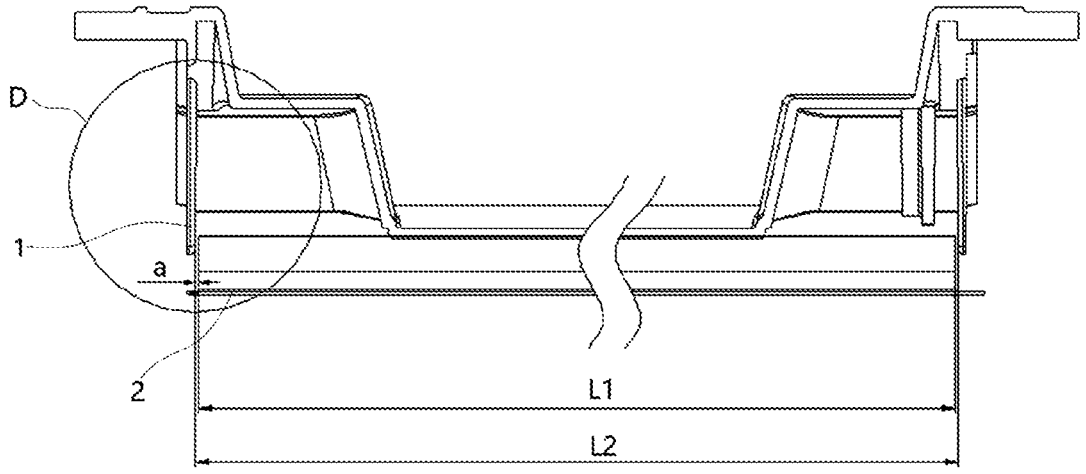
FIG. 7 is a side schematic diagram of the longitudinal ends of the plate bodies in the air port component of the present disclosure.

Further, referring to FIG. 7, a first preset gap a exists at the connection between the elastic plate 13 and at least one of the first plate body 1 and the second plate body 2 along the longitudinal direction, and the first preset gap a is a gap that is reserved after the second plate body is assembled at the room temperature. By disposing the first preset gap a, compensation is be performed when the elastic plate 13 and the plate body detachably connected thereto approach to each other due to temperature changes, so as to reduce the possibility of plastic deformation of the first plate body 1 and the second plate body 2. The elastic plate 13 is both connected to a structural member existing on the plate body, such as a snap-fit structure, or a structure for connecting the elastic plate 13 only may also be additionally disposed on the plate body.

Figure 4:
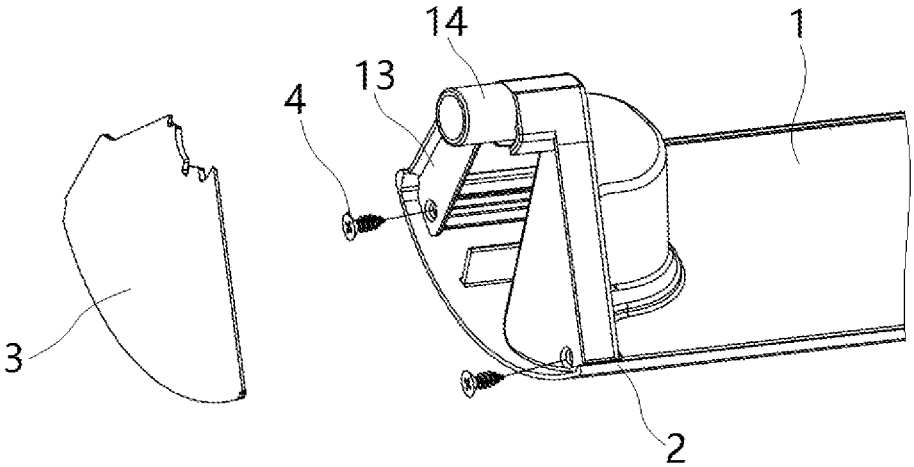
FIG. 4 is an exploded schematic diagram of longitudinal ends of plate bodies in the air port component of the present disclosure.

In an embodiment as shown in FIG. 4, the elastic plate 13 is disposed on the first plate body 1, and the elastic plate 13 is detachably connected with the second plate body 2. In the structure in which the first plate body 1 is made of plastic and the second plate body 2 is made of an aluminum alloy, the elastic plate 13 and the first plate body 1 may be integrally formed by injection molding, so that the processing difficulty is reduced, and furthermore, there is a sufficient space for disposing the elastic plate 13 on the first plate body 1 facing to the interior of the air conditioner.

As shown in FIG. 1, the snap-fit structure between the first plate body 1 and the second plate body 2 are configured as follows. A first buckle group is disposed on one side of the first plate body 1 facing to the second plate body 2, a second buckle group is disposed on one side of the second plate body 2 facing to the first plate body 1, and the first buckle group and the second buckle group collectively forms the snap-fit structure. The elastic plate 13 is disposed on the first plate body 1, and the elastic plate 13 is located on an outer side of the second buckle group along the longitudinal end and is connected to the end of the second buckle group in a state in which the first plate body 1 and the second plate body 2 are buckled through the first buckle group and the second buckle group.

Due to this arrangement, the second buckle group is used as a connecting structure to be connected with the elastic plate 13, the existing structure on the plate body would be utilized, moreover, the elastic plate 13 is located on the outer side of the snap-fit structure along the longitudinal direction and cover the gap between the first and second plate bodies, and prevent cold air from entering into the gap to prevent condensation.

In this structure, a first preset gap a is disposed between the elastic plate 13 and an outer end face of the second buckle group along the longitudinal direction.

In the embodiment in which the elastic plate 13 is fixed to the outer side of the longitudinal end of the second buckle group, in the case of a relatively large working environment temperature difference, even if the difference between the linear expansion coefficients of the materials of the first and second plate bodies is relatively large, since the elastic plate 13 has elasticity, and the first preset gap a exists between the elastic plate 13 and the outer end face of the second buckle group, the elastic deformation of the plate bodies due to temperature changes is compensated, and the acting force between the first and second plate bodies in the case of the elastic deformation is reduced, thereby reducing the degree of plastic deformation of the first and second plate bodies, and then the strength of the entire air port component is ensured.

If the linear expansion coefficient of the material of the second plate body 2 is less than the linear expansion coefficient of the material of the first plate body 1, when the environment temperature is relatively high, the first plate body 1 has a longitudinal elongation greater than that of the second plate body 2 since the linear expansion coefficient of the material is large. At this time, an upper end of the elastic plate 13 may elastically deform outward, so that the deformation of the first and second plate bodies is minimized. When the environment temperature is relatively low, since the first plate body 1 has a large linear expansion coefficient of the material, the longitudinal amount of contraction of the first plate body 1 is greater than that of the second plate body 2. At this time, the first preset gap a is reduced, the elastic plate 13 elastically deforms accordingly, in this way, even if the first plate body 1 contracts, it will not exert a large force on the second plate body 2 so as to minimize the deformation of the first and second plate bodies, thereby maintaining the original shape of the first and second plate bodies.

As shown in FIG. 2 and FIG. 4, in order to fix the first plate body 1 and the second plate body 2 at the longitudinal ends, the air port component further includes a fastener 4, and the elastic plate 13 and the longitudinal ends of the second buckle group are fixed through the fastener 4. Specifically, a mounting hole 131 is formed in the elastic plate 13, a threaded hole is formed in an outer end of the second buckle group along the longitudinal direction, and the fastener 4 such as a screw and the like is inserted into the mounting hole 131 and the threaded hole to achieve the fixation of the elastic plate 13 and the second buckle group.

During the pre-tightening of the fastener 4, the first preset gap a exists between the elastic plate 13 and the outer end face of the second buckle group along the longitudinal direction by adjusting the torque on the fastener 4, instead of disposing a relatively large gap for the first and second plate bodies in the traditional pure buckle connection or glue bonding, and since the gap is formed in the inner side of the elastic plate 13, the cold air can be prevented from entering into the space between the first and second plate bodies to generate condensation.

Further, the elastic component includes an elastic spacer, the elastic spacer is located between the elastic plate 13 and the second buckle group, that is, disposed in the first preset gap a, and the thickness of the elastic spacer is consistent with the first preset gap a for eliminating the first preset gap a. By disposing the elastic spacer, when the fastener 4 is installed, the first preset gap a is adjusted relatively easily and accurately during the assembly.

In some embodiments, the elastic spacer is a rubber pad, the rubber pad is spaced between the elastic plate 13 and the second buckle group, and the thickness of the rubber pad in a free state is consistent with the first preset gap a. Alternatively, the elastic spacer is also be a spring, the spring is disposed between the elastic plate 13 and the second buckle group, and the length of the spring in the free state is consistent with the first preset gap a.

Figure 8:
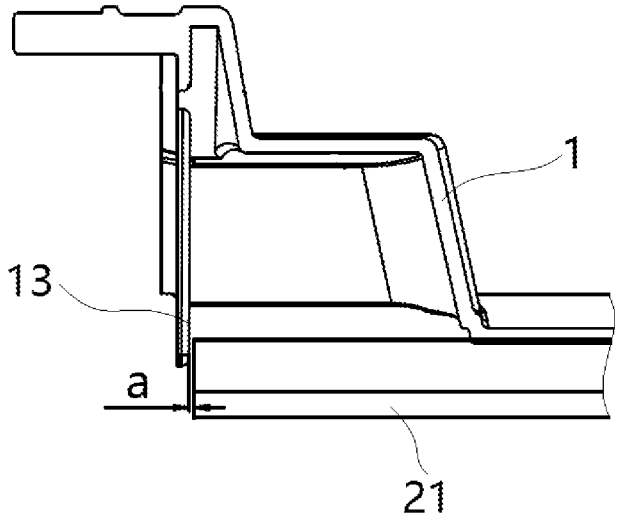
FIG. 8 is an enlarged drawing of a section D shown in FIG. 7.

A method for determining the first preset gap a is descried below. Referring to FIG. 7 and FIG. 8, the elastic plate 13 is fixed to the first plate body 1, and there is a first preset gap a between the elastic plate 13 and the outer end face of the second buckle group on the second plate body 2.

For example, the first plate body 1 is an injection molding part, the second plate body 2 is an aluminum part or is made of a other lightweight high-strength materials, the coefficient A of thermal expansion of a plastic material is higher than the coefficient B of thermal expansion of an aluminum material, therefore, the coefficient A of thermal expansion of the first plate body 1 is higher than the coefficient B of thermal expansion of the second plate body 2. The first preset gap $a=(L2-L1)/2=(L2*A*\Delta T-L1*B*\Delta T)+(E1+E2)$, wherein: L1 represents the distance between two sides of the two longitudinal ends of the second plate body 2 connected to the elastic component, and specifically, L1 represents the distance between the two outer sides of the second buckle group on the second plate body 2 along the longitudinal direction in FIG. 7; L2 represents the distance between inner sides of the elastic plates 13 at both ends of the first plate body 1; E1 represents an upper tolerance value of L1, and E2 represents a lower tolerance value of L2; A represents the coefficient of thermal expansion of the first plate body 1, B represents the coefficient of thermal expansion of the second plate body 2, and $A>B$; and $\Delta T$ represents an environment temperature difference of the air conditioner.

Figure 3:
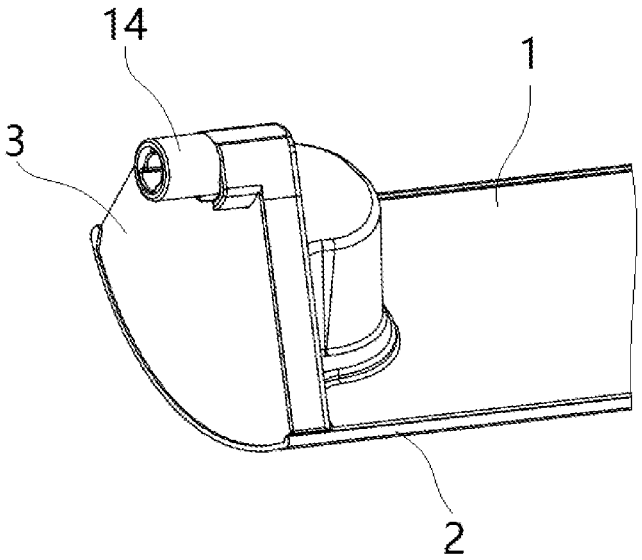
FIG. 3 is a structural schematic diagram of longitudinal ends after the first and second plate bodies in the air port component of the present disclosure are mounted.

In order to further prevent cold air from entering the air port component, the air port component includes a cover plate 3. The cover plate 3 is disposed on the outer side of the elastic plate 13 along the longitudinal direction of an air conditioner wind deflector, so as to seal the gap at the longitudinal ends of the first plate body 1 and the second plate body 2, so as to achieve a better anti-condensation effect. As shown in FIG. 4, the base end part of the second plate body 2 has an extended end relative to the longitudinal end of the second buckle group, the length of the extended end is greater than the total thickness of the elastic plate 13 and the cover plate 3, FIG. 3 shows a structural schematic diagram of the cover plate 3 after installation, even if the amount of contraction of the second plate body 2 is relatively large due to environment temperature changes, since the end of the second plate body 2 exceeds the outer side face of the cover plate 3, a gap between the second plate body 2 and the cover plate 3 is avoided, which not only prevents the cold air from entering the air deflector device, but also ensures the aesthetic feeling of the appearance of the front face of the air conditioner.

Figure 5:
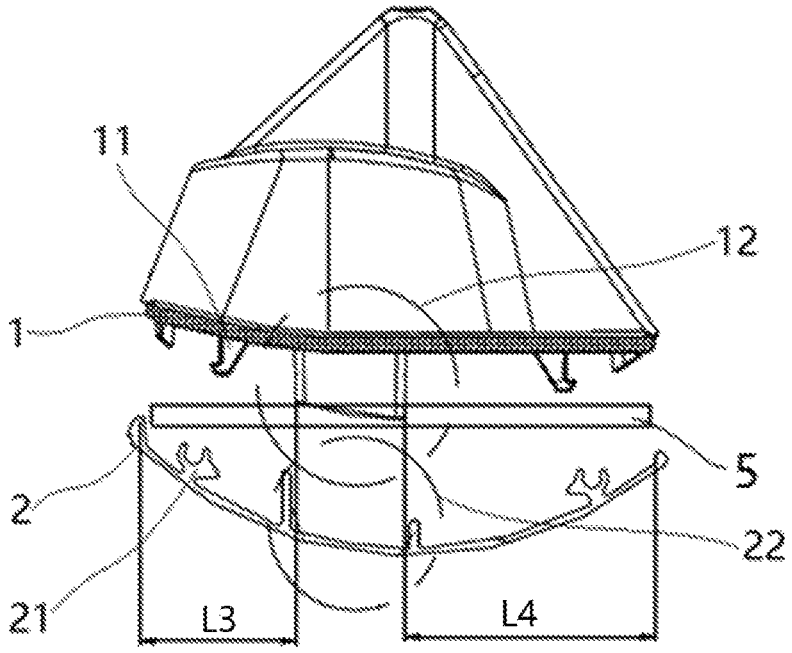
FIG. 5 is a sectional view when the first and second plate bodies in the air port component of the present disclosure are in upper and lower alignment state prior to assembly.

Further, as shown in FIG. 5, the air port component further includes a flexible pad 5, such as sponge or rubber or the like, the flexible pad 5 is disposed between the first plate body 1 and the second plate body 2, there is a second preset gap b at the connection of the first buckle group and the second buckle group, and the flexible pad 5 is filled in the second preset gap b. Because the flexible pad 5 is soft and large in compression amount, so the deformation of the first buckle group and the second buckle group due to environment temperature changes is alleviated, thereby avoiding abnormal noise; and furthermore, an effective connection is formed between the first and second plate bodies, so that the plate bodies extend or contract in the longitudinal and lateral directions.

A specific arrangement form of the first buckle group and the second buckle group is given below, as shown in FIG. 1, the first buckle group includes two groups of first buckle structures 1 disposed on two longitudinal edges of the first plate body 1 respectively, and each group of first buckle structures 11 includes a plurality of first buckle structures 11 disposed at internals along the longitudinal direction of the first plate body 1. For example, the plurality of first buckle structures 11 in each group of first buckle structures 11 are evenly spaced, and an enlarged drawing B in FIG. 1 shows the shape of a single first buckle structure 11. The second buckle group includes two groups of second buckle structures 21 disposed at the two lateral ends of the second plate body 1 respectively, and each group of second buckle structures 21 includes strip-shaped buckles extending along the longitudinal direction of the second plate body 2.

Specifically, in the sectional view of the first and second plate bodies as shown in FIG. 5 prior to assembly, the section of each first buckle structure 11 is a hook-shaped structure with an outward free end, the second plate body 2 has an arc-shaped structure, the section of each strip-shaped buckle is a clamping structure with irregular section, when the first plate body 1 pressed downward aligning the second plate body 2, the second plate body 2 generates elastic deformation along the lateral direction, the distance between two strip-shaped buckles is increased, so that each first buckle structure 11 is located on the inner side of the strip-shaped buckle, and after the first plate body 1 is released, each first buckle structure 11 is clamped with the corresponding strip-shaped buckle. Referring to an enlarged drawing C in FIG. 6, the first buckle structure 11 and a second buckle structure 21 have a second preset gap b in the height direction, and the second preset gap b is filled by the flexible pad 5 disposed between the upper second plate bodies.

It can be seen from FIG. 5 that, due to the asymmetric structure of the first and second plate bodies at both ends along the lateral direction, and the difference between the two ends of the second plate body 2 along the lateral direction is relative small, it is not easy to be clearly recognized by a user during assembly, so an error prevention structure is be additionally disposed on the first and second plate bodies to ensure a correct mounting direction of the first and second plate bodies. Specifically, a first guide structure 12 is disposed on one side of the first plate body 1 facing to the second plate body 2, and the first guide structure 12 is located between the two groups of first buckle structures 11 in the lateral direction; and a second guide structure 22 is disposed on one side of the second plate body 2 facing to the first plate body 1, and the second guide structure 22 is located between the two groups of second buckle structures 21 in the lateral direction. The first guide structure 12 and the second guide structure 22 are spaced differently relative to the lateral center positions of the first plate body 1 and the second plate body 2, that is, the distance L3 between the first guide structure and one lateral end of the guide plate is unequal to the distance L4 between the second guide structure and other lateral end of the guide plate. Correct installation is achieved when the first plate body 1 and the second plate body 2 are correctly mounted, and correct installation cannot be achieved when the mounting direction of the first plate body 1 and the second plate body 2 is wrong.

Further, the first guide structure 12 and the second guide structure 22 have different height, and thus form a complementary structure, which prevents the first guide structure and the second guide structure from cooperating in place when the first plate body 1 and the second plate body 2 are incorrectly mounted.

It can be seen from FIG. 1 that, the first guide structure 12 includes two frame-shaped protrusion, a partition plate is arranged in the middle of the rectangular frame protrusion along the longitudinal direction of the plate body. As shown in an enlarged view A in FIG. 1, the two frame-shaped protrusion are respectively disposed close to the longitudinal ends of the first plate body 1. The second guide structure 22 includes two strip-shaped protrusions, the strip-shaped protrusions extend along the longitudinal direction of the second plate body 2, and the two strip-shaped protrusions are located between the two groups of second buckle structures 21 and spaced differently relative to the center of the second plate body 2 along the lateral direction.

Figure 6:
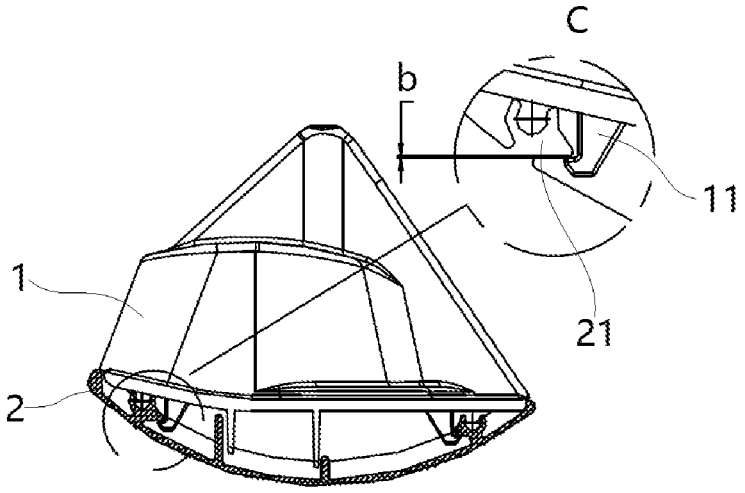
FIG. 6 is a sectional view after the first and second plate bodies in the air port component of the present disclosure are assembled.

Referring to FIG. 6, the two strip-shaped protrusion have different heights, the left side protrusion is higher than the right side protrusion, correspondingly, two side plates of each frame-shaped protrusion also have a height difference along the lateral direction, but the protrusion height of the left side plate of the frame-shaped protrusion is lower than that of the right side plate. After the first and second plate bodies are mounted in place, the two frame-shaped protrusions is embedded between the two strip-shaped protrusion. It the mounting direction is wrong, the height difference of the guide structures will block the two plate bodies to be mounted in place. Since the second plate body 2 is circular arc-shaped between the two strip-shaped protrusions, correspondingly, the top of the frame-shaped protrusion is designed as mating circular arc shapes. After the two plate bodies are mounted in place, a relatively small gap is retained between the two circular arc surfaces of the first and second plate bodies, so that the snap-fit structure is mounted in place.

Further, the first guide structure 12 is higher than the first buckle group, so that it cannot be assembled in place even in the case of reverse installation, or the snap-fit structure is not damaged even if forced by external force, so as to reduce assembly errors during the production.

In order to realize the movement of the air deflector to adjust the size of the air outlet of the air conditioner, as shown in FIG. 2, the first plate body 1 is provided with a driving member mounting interface 14 for mounting a driving member capable of driving the first plate body 1 and the second plate body 2. The driving member mounting interface 14 is disposed on the first plate body 1, when the first plate body 1 is made of plastic, it is convenient to be integrally formed with the first plate body 1 by injection molding to reduce processing difficulty; and it plays a mutual reinforcement role with the elastic plate 13 to ensure the strength of the structure, so that the driving member stably and accurately drives the air deflector device. In addition, compared with the structure in which the driving member mounting interface 14 is disposed on the second plate body 2, there is need to form an opening for enabling a power output shaft of the driving member to pass through in the first plate body 1 in this driving manner, and the strength of the first plate body 1 is ensured.

Specifically, still referring to FIG. 2, the longitudinal end of the first plate body 1 is configured as a supporting structure that arches away from the second plate body. The supporting structure is provided with inclined side plates 15 on both sides along the lateral direction of the first plate body 1 respectively, the bottom ends of the two side plates 15 are connected with the first plate body 1, the driving member mounting interface 14 is disposed at a position where the top ends meet, and the axial line of the driving member mounting interface 14 is consistent with the longitudinal direction of the first plate body 1. Two elastic plate 13 are respectively fixed to the two ends of the two side plates 15, and the two elastic plates 13 are spaced apart.

When the air conditioner air deflector device of the present disclosure is assembled, as shown in FIG. 5, the second plate body 2 is placed below, and the entire sponge is pasted on the inner side of the second plate body 2, and meanwhile the sponge covers the second buckle group; due to the error prevention structure, the first plate body 1 is placed above the second plate body 2 in the correct direction, and the first plate body 1 is pressed down, and by means of the guide of the first guide structure 12 and the second guide structure 22, the distance between the two air deflectors is reduced, until the first buckle group and the second buckle group are buckled in place. Finally, as shown in FIG. 4, the elastic plate 13 and the second plate body 2 are fixed by the fastener 4.

In addition, the present disclosure further relates to an air conditioner, including the air port component described in the above embodiment. Since such an air deflector device is not easily deformed when the environment temperature changes greatly, the air conditioner of the present disclosure at least has one of the following advantages:

it improves the air guide reliability of the air conditioner, and it is not easy to get stuck;

when the air conditioner works, the noise of mutual friction between the air deflector device and the main structure is small; and the airflow design of the air outlet of the air conditioner meets the design requirements, which prevents condensation due to local overcooling, thereby improving the working performance of the air conditioner.

The air port component and the air conditioner provided by the present disclosure have been described in detail above. Specific embodiments are used herein to explain the principles and implementations of the present disclosure. The descriptions of the above embodiments are only used to help to understand the methods and core ideas of the present disclosure. It should be noted that, for those of ordinary skill in the art, without departing from the principles of the present disclosure, several improvements and modifications may be made to the present disclosure, and these improvements and modifications also fall within the protection scope of the claims of the present disclosure.

The invention claimed is:

1. An air port component of an air conditioner, comprising:

a first plate body and a second plate body, wherein two longitudinal ends of the first plate body are elastically connected with two longitudinal ends of the second plate body respectively; and an elastic component, wherein the two longitudinal ends of the first plate body are elastically connected with the two longitudinal ends of the second plate body respectively through the elastic component;

wherein the elastic component comprises an elastic plate, and the elastic plate is connected to the longitudinal ends of the first plate body and the second plate body;

wherein a first preset gap in a longitudinal direction of the air port component exists at the connection of the elastic plate and each of the two longitudinal ends of at least one of the first plate body and the second plate body.

2. The air port component as claimed in claim 1, wherein the elastic component further comprises an elastic spacer, and the elastic spacer is disposed in the first preset gap.

3. The air port component as claimed in claim 2, wherein the elastic spacer comprises a rubber pad, and a thickness of the rubber pad in a free state is consistent with the first preset gap; or the elastic spacer comprises a spring, and a height of the spring in the free state is consistent with the first preset gap.

4. The air port component as claimed in claim 1, wherein the elastic plate is disposed on the first plate body (1), and the elastic plate and the second plate body (12) are detachably connected.

5. The air port component as claimed in claim 1, wherein a first buckle group is disposed on one side of the first plate body facing to the second plate body, a second buckle group is disposed on one side of the second plate body facing to the first plate body, the first buckle group is snapped with the second buckle group, and the elastic plate is located at an outer side of the longitudinal end of the second buckle group and is connected with an end of the second buckle group.

6. The air port component as claimed in claim 5, further comprising a fastener, wherein the elastic plate is connected to a longitudinal end of the second buckle group through the fastener.

7. The air port component as claimed in claim 5, further comprising a flexible pad, wherein a second preset gap exists at a site on which the first buckle group matches the second buckle group, and the flexible pad is disposed between the first plate body and the second plate body and is filled in the second preset gap.

8. The air port component as claimed in claim 5, wherein the first buckle group comprises two groups of first buckle structures disposed at two lateral ends of the first plate body respectively, and each group of first buckle structures comprises a plurality of first buckle structures disposed at intervals along the longitudinal direction of the first plate body; and the second buckle group comprises two groups of second buckle structures disposed at two lateral ends of the second plate body respectively, and each group of second buckle structures comprises strip-shaped buckles extending along the longitudinal direction of the second plate body, and the first buckle structures match with the strip-shaped buckles correspondingly.

9. The air port component as claimed in claim 1, wherein a driving member mounting interface is disposed on the first plate body, so as to mount a driving member capable of driving the first plate body and the second plate body.

10. The air port component as claimed in claim 1, further comprising a cover plate, wherein the cover plate is arranged on an outer side of the elastic component, so as to seal a gap on the longitudinal ends of the first plate body and the second plate body.

11. The air port component as claimed in claim 1, wherein a first guide structure is disposed on one side of the first plate body facing to the second plate body, a second guide structure is disposed on one side of the second plate body facing to the first plate body, the first guide structure and the second guide structure are spaced differently relative to a lateral centerline of the air port component, and are installed in place when the first plate body and the second plate body are correctly mounted.

12. The air port component as claimed in claim 11, wherein the first guide structure and the second guide structure have different heights to form a complementary structure, preventing the first guide structure and the second guide structure from installing in place when the first plate body and the second plate body are incorrectly mounted.

13. The air port component as claimed in claim 11, wherein a first buckle group is disposed on one side of the first plate body facing to the second plate body, and the first guide structure is higher than the first buckle group.

14. The air port component as claimed in claim 1, wherein the elastic plate is disposed on the first plate body, and the first preset gap gap $a=(L2*A*\Delta T-L1*B*\Delta T)+(E1+E2)$, wherein, L1 represents a distance between two sides of the two longitudinal ends of the second plate body connected by the elastic component;

L2 represents a distance between two inner sides of the elastic plates at both ends of the first plate body;

E1 represents an upper tolerance value of L1, and E2 represents a lower tolerance value of L2;

A represents a coefficient of thermal expansion of the first plate body, B represents a coefficient of thermal expansion of the second plate body, and A>B; and $\Delta T$ represents a temperature difference between an air temperature at the air port component and an environmental temperature of a room on which the air conditioner is located.

15. An air conditioner, comprising the air port component as claimed in claim 1.

* * * * *